US012474112B2

(12) United States Patent
Pagnozzi et al.

(10) Patent No.: US 12,474,112 B2
(45) Date of Patent: Nov. 18, 2025

(54) PULL OUT DRAWER WITH INTEGRATED WINE RACK

(71) Applicant: ELECTROLUX DO BRASIL S.A., Curitiba (BR)

(72) Inventors: Rodrigo Marge Pagnozzi, Curitiba (BR); Aguilar Da Silva, Curitiba (BR); Alexandre Sauer, Curitiba (BR); Alcione Colecha, Curitiba (BR); Guilherme Rissatto Picanço, Curitiba (BR); Israel Mercer Neto, Curitiba (BR); Augusto Biscaia Da Silva, Curitiba (BR); Cristhian Camilo Serrano Camacho, Charlotte, NC (US)

(73) Assignee: Electrolux do Brasil S.A., Curitiba (BR)

( * ) Notice: Subject to any disclaimer, the term of this patent is extended or adjusted under 35 U.S.C. 154(b) by 0 days.

(21) Appl. No.: 17/769,354

(22) PCT Filed: Oct. 18, 2019

(86) PCT No.: PCT/BR2019/050451

§ 371 (c)(1),
(2) Date: Apr. 15, 2022

(87) PCT Pub. No.: WO2021/072513

PCT Pub. Date: Apr. 22, 2021

(65) Prior Publication Data

US 2023/0146700 A1 May 11, 2023

(51) Int. Cl.

| | |
|---|---|
| ***F25D 25/02*** | (2006.01) |
| ***A47B 73/00*** | (2006.01) |
| ***F25D 23/06*** | (2006.01) |

(52) U.S. Cl.

CPC ..... *F25D 25/025* (2013.01); *F25D 23/067* (2013.01); *F25D 25/02* (2013.01);

(Continued)

(58) Field of Classification Search

CPC ..... F25D 25/025; F25D 25/02; F25D 25/024; F25D 2331/803; F25D 2331/809; F25D 2325/021; F25D 231/007; F25D 23/067

See application file for complete search history.

(56) References Cited

U.S. PATENT DOCUMENTS 2,005,939 A * 6/1935 Hibbard, Jr. ..... F25D 25/02 211/74
2,114,878 A * 4/1938 Harbison ..... F25D 25/021 312/351

(Continued)

FOREIGN PATENT DOCUMENTS

CN 101063584 10/2007
CN 202002429 10/2011

(Continued)

OTHER PUBLICATIONS

International Search Report for PCT/BR2019/050451 dated May 19, 2020, 1 pages.

(Continued)

*Primary Examiner* — Kimberley S Wright
(74) *Attorney, Agent, or Firm* — Chrisman Gallo Tochtrop LLC

(57) ABSTRACT

A multipurpose drawer assembly in a refrigeration appliance that can be accommodated in a first position in which the open storage area is oriented upwards, or a second position in which a bottle rack is oriented upwards, the second position being inverted relative to the first position. The first position accommodates food items therein. The second position accommodates at least one bottle. The at least one drawer include first and second side walls, a rear wall, and a bottom wall that together define an open storage area therein. The bottom wall includes a first surface defining a base of the storage area and second surface opposite of the (Continued)

first surface and exterior of the storage area. The bottle rack is positioned on the second surface of the bottom wall.

13 Claims, 6 Drawing Sheets

(52) U.S. Cl.
CPC .. *F25D 2325/021* (2013.01); *F25D 2331/803* (2013.01); *F25D 2331/809* (2013.01)

(56) References Cited

U.S. PATENT DOCUMENTS

| | | | | | |
|---|---|---|---|---|---|
| 2,115,321 | A * | 4/1938 | Schweller | F25D 25/021 108/62 |
| 2,215,665 | A * | 9/1940 | Hedlund | F25D 25/021 312/246 |
| 7,673,761 | B2 | 3/2010 | Lee et al. | |
| 8,075,075 | B2 | 12/2011 | Haller et al. | |
| 8,651,598 | B2 | 2/2014 | Go et al. | |
| 9,028,020 | B2 | 5/2015 | Gossens et al. | |
| 9,445,669 | B2 | 9/2016 | Li et al. | |
| 9,664,439 | B2 | 5/2017 | Mirza et al. | |
| 10,820,725 | B1 * | 11/2020 | Fagundes | A47B 88/988 |
| 2011/0016909 | A1 | 1/2011 | Mirza et al. | |
| 2016/0037917 | A1 | 2/2016 | Ronshen | |
| 2017/0343276 | A1 | 11/2017 | Cheon | |
| 2018/0031308 | A1 | 2/2018 | Yang et al. | |
| 2018/0231301 | A1 | 8/2018 | Choi et al. | |
| 2018/0328653 | A1 * | 11/2018 | Alves Ferreira | F25D 25/021 |
| 2020/0121080 | A1 * | 4/2020 | Wantland | A47B 96/025 |

FOREIGN PATENT DOCUMENTS

| | | | | | |
|---|---|---|---|---|---|
| CN | 102494506 | A * | 6/2012 | F25D 23/04 |
| CN | 102506556 | A * | 6/2012 | F25D 23/04 |
| CN | 202562197 | U * | 11/2012 | |
| CN | 204027185 | | 12/2014 | |
| CN | 205909615 | | 1/2017 | |
| CN | 206420235 | | 8/2017 | |
| CN | 207849884 | | 9/2018 | |
| DE | 19751308 | A1 * | 5/1999 | A47B 73/008 |
| DE | 102011006961 | | 10/2012 | |
| EP | 1591732 | A1 * | 11/2005 | B65D 81/18 |
| EP | 2159523 | A1 * | 3/2010 | A47B 88/40 |
| EP | 2375203 | | 10/2011 | |
| EP | 2927148 | | 10/2015 | |
| EP | 3128272 | | 2/2017 | |
| JP | H0719722 | | 1/1995 | |
| KR | 20080066450 | A * | 7/2008 | |
| WO | WO-9805910 | A1 * | 2/1998 | A47B 73/008 |
| WO | 1999026032 | | 5/1999 | |
| WO | 2006011084 | | 2/2006 | |
| WO | 2008052977 | | 5/2008 | |
| WO | 2013010801 | | 1/2013 | |
| WO | 2014079707 | | 5/2014 | |
| WO | 2017076824 | | 5/2017 | |
| WO | 2019016516 | | 9/2019 | |
| WO | 2019165521 | | 9/2019 | |

OTHER PUBLICATIONS

Supplementary European Search Report for app No. EP19949377 dated May 19, 2023, 20 pages.
English translation of Chinese Office action for app no. 201980101866.2 dated Nov. 14, 2024, 12 pages.

* cited by examiner

PULL OUT DRAWER WITH INTEGRATED WINE RACK

FIELD OF THE INVENTION

The present application relates generally to a multipurpose drawer within an appliance. More particularly, it relates to a drawer for a refrigeration appliance that is capable of achieving a first configuration to store food items and a second configuration to store bottles, in which the second configuration is inverted relative to the first configuration.

BACKGROUND OF THE INVENTION

In conventional models, a refrigeration appliance includes a drawer to store food items and a separate assembly to store bottles. This creates an inefficient use of space within the refrigeration appliance. In other models, a drawer to store food items as well as bottles would require some additional modification to the drawer or appliance cabinet to accommodate both types of items.

It is an objective of the present disclosure to alleviate or overcome one or more difficulties related to the prior art. It has been found that a new multipurpose drawer assembly can be configured to accommodate food items in one position and bottles in another position without any additional modification. Specifically, a user can store food items in a first position, and flip the drawer upside down to a second position to store bottles.

BRIEF SUMMARY OF THE INVENTION

In accordance with one aspect, a multipurpose drawer assembly in a refrigeration appliance comprises at least one drawer including first and second side walls, a rear wall, and a bottom wall that together define an open storage area therein. The bottom wall includes a first surface defining a base of the storage area and a second surface opposite of the first surface that forms an exterior bottom of the drawer. A bottle rack is positioned on the second surface of the bottom wall. The drawer assembly can be accommodated within said refrigeration appliance in a first position in which the open storage area is oriented upwards in normal operation to accommodate food items within the storage area, or a second position in which the bottle rack is oriented upwards in normal operation to accommodate at least one bottle, the second position being inverted relative to the first position.

The drawer assembly further includes a front handle positioned in between the first and second side wall.

The bottle rack is integral to the second surface of the bottom wall.

The bottom wall includes a support mount configured to secure the bottle rack.

The bottle rack includes a frame and a plurality of support members arranged within the frame, each support member having at least one curve.

The bottle rack is made of metal wire.

The drawer assembly further comprises at least one guide rail assembly secured to an exterior of each of the first and second side walls.

The at least one guide rail assembly includes a guide rail and a wheel having a perimeter edge that extends beyond each of a top surface and a bottom surface of the guide rail.

In accordance with a second aspect, a refrigeration appliance comprises a cabinet defining a storage space defined between first and second interior walls and including an inner guide track on said first and second interior walls. A drawer assembly includes first and second side walls, a rear wall, and a bottom wall that together define an open storage area therein, and at least one guide rail assembly secured to an exterior of the first and second side walls. The bottom wall comprises a first surface defining a base of the storage area and a second surface opposite of the first surface that forms an exterior bottom of the drawer. A bottle rack is positioned on the second surface of the bottom wall. The inner guide track is configured to accept the at least one guide rail assembly in a first position in which the open storage area is oriented upwards in normal operation to accommodate food items within the storage area, or a second position in which the bottle rack is oriented upwards in normal operation to accommodate at least one bottle, the second position being inverted relative to the first position.

The at least one guide rail assembly includes a guide rail and a wheel having a perimeter edge that extends beyond a top and bottom surface of the guide rail.

The inner guide track includes a slide track and a guide wheel.

The bottle rack includes a frame and a plurality of support members arranged within the frame, each support member comprising at least one depression.

The at least one depression comprises a curved geometry.

Each support member comprises at plurality of depressions arranged in an array extending laterally along a width of the bottom wall so that the bottle rack is configured to support multiple bottles.

The second surface of the bottom wall comprises an integral support mount configured to receive the frame of the bottle rack.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF PREFERRED EMBODIMENTS

Figure 1:
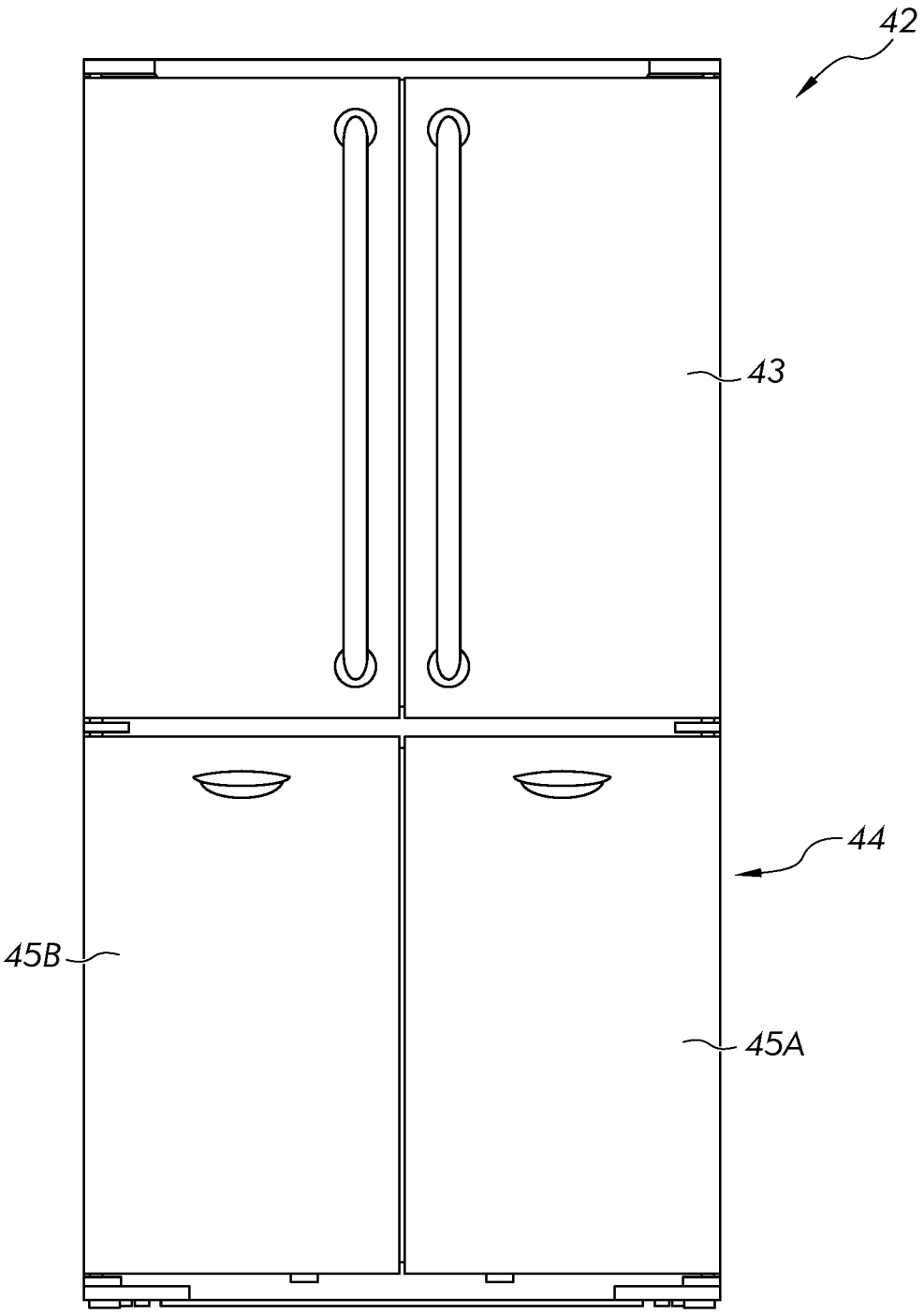
FIG. 1 is a front schematic view of a refrigerator.

Example embodiments are described and illustrated in the drawings. These illustrated examples are not intended to be limiting. For example, one or more aspects or features from each embodiment can be combined with or utilized in other embodiments.

Herein, when a range such as 5-25 (or 5 to 25) is given, this means preferably at least 5 and, separately and independently, preferably not more than 25. In an example, such a range defines independently at least 5, and separately and independently, not more than 25.

Referring now to the drawings, FIG. 1 shows an example refrigeration appliance in the form of a domestic refrigerator, indicated generally at 42. Although the detailed description that follows is described with reference to a domestic refrigerator 42, the invention can be embodied by a refrigeration appliance other than a domestic refrigerator 42. Further, an embodiment is described in detail below, and shown in the figures as a French door configuration of a refrigerator 42, including four "French" style doors, having two pairs of adjacent doors positioned on top of the other. Other refrigeration appliance configurations can be utilized, such as a single door upright refrigerator, a top-mount refrigerator (i.e., the freezer is located vertically-above the fresh food compartment), a bottom-mount refrigerator (i.e., the freezer is located vertically-below the fresh food compartment), a French-door bottom-mount refrigerator (i.e., a bottom-mount refrigerator that includes adjacent "French" style doors), a side-by-side refrigerator (i.e., the freezer compartment is on one side and the fresh food compartment is on the other side, opposite of the freezer compartment), etc.

The refrigeration compartment 43 of the appliance is used to cool and/or maintain articles of food and/or beverages in a cooled condition. As shown, the refrigerator 42 includes a structural outer cabinet 44 and an interior liner 46 (FIGS. 2A, 2B) defining the separate fresh food and freezer compartments within the cabinet 44. In the shown example, the upper pair of French doors provide access to the single upper fresh food compartment 43 configured to store food at above-freezing temperatures (i.e., above 0° C., such as between 0.25° C. and 4.5° C.) while the lower pair of French doors provide access to two separate compartments 45A, 45B. In one example, the two separate compartments 45A, 45B can both be freezer compartments configured to store food at below-freezing temperatures (i.e., below 0° C., such as between 0° C. and −20° C.). Alternatively, at least one of the separate compartments, such as compartment 45B, can be a variable temperature compartment (VCZ, also known as a convertible compartment) with a temperature that is user-selectable between fresh food and freezer temperatures (i.e., user selectable to be above-freezing or below-freezing). Separate interior liners are used to define the separate fresh food and freezer compartments, however it is contemplated that a single liner could be used. The interior liner 46 comprises a top surface, a bottom surface, a rear surface, a first side surface, and a second side surface being parallel to the first side surface and spaced therefrom via the rear side surface.

The freezer compartment 45A and/or convertible compartment 45B is selectively accessible via a freezer door that is rotatably secured to the cabinet 44. Moreover, the fresh food compartment 43 is selectively accessible via the fresh food doors that are likewise rotatably secured to the cabinet 44. Storage shelves can be located within the fresh food compartment 43 and extend horizontally between the first and second side surfaces of the liner.

Figure 2A:
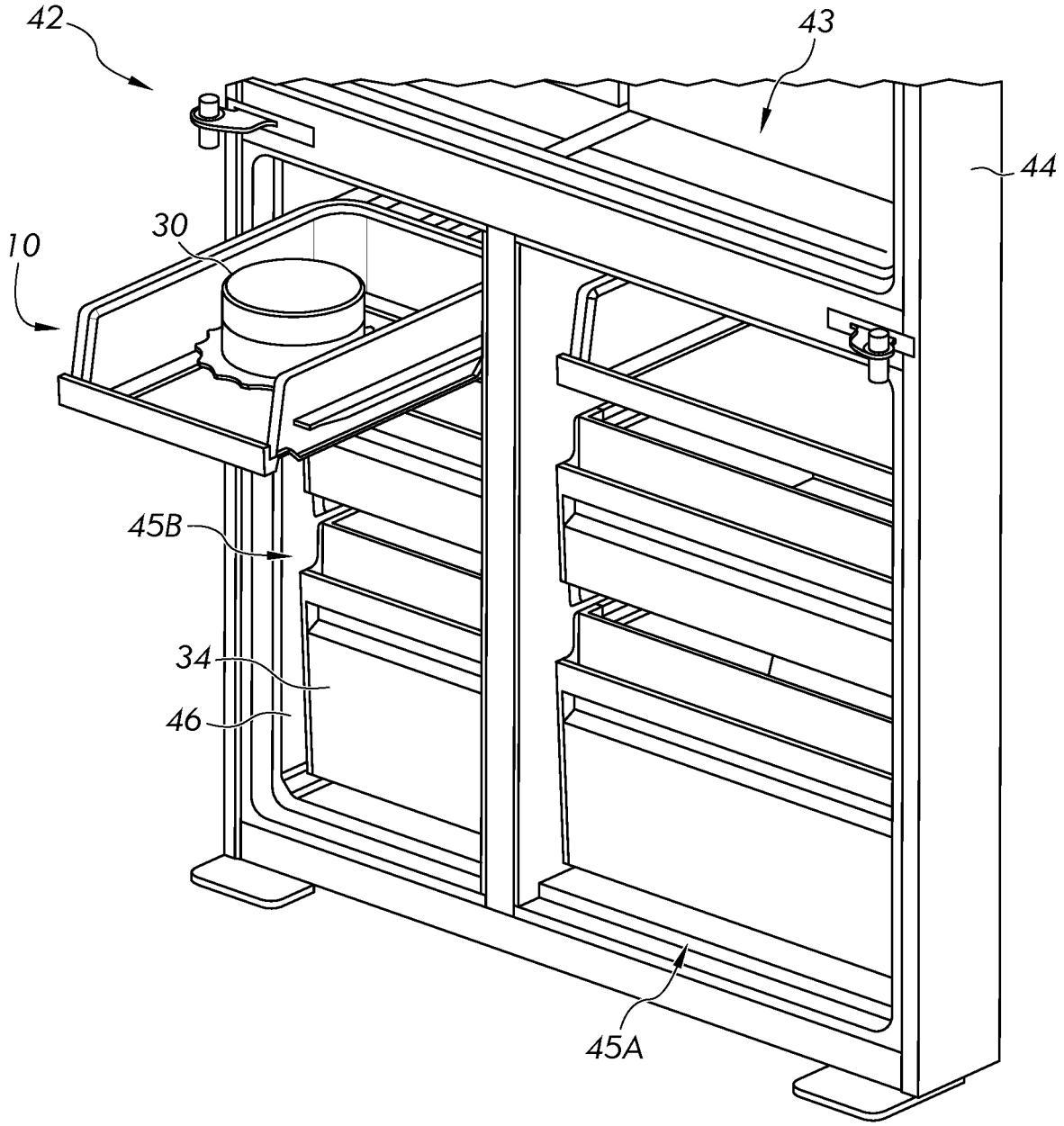
FIG. 2A is a perspective view of an example domestic refrigeration appliance with an example drawer assembly in a first position.
Figure 2B:
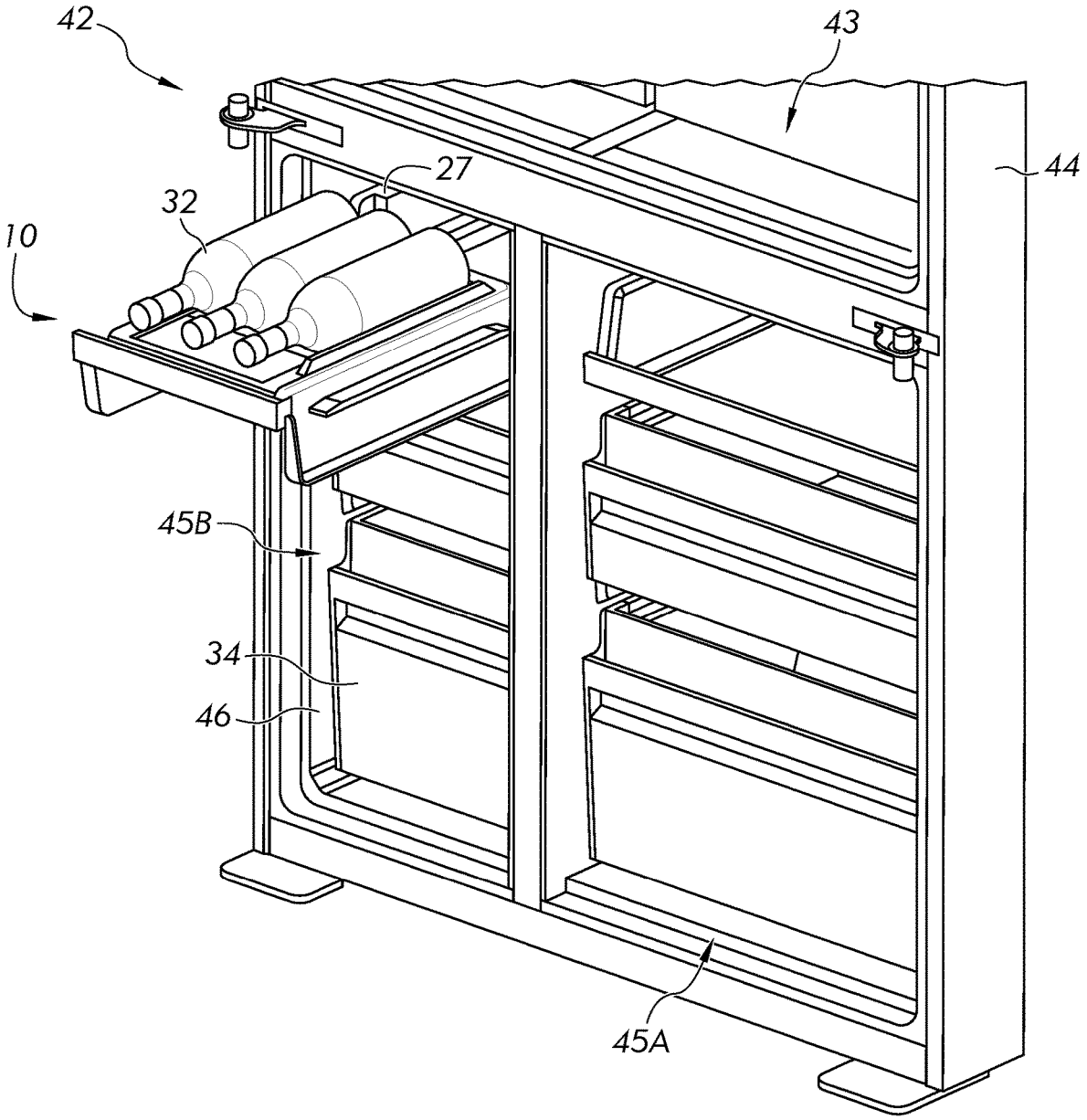
FIG. 2B is a perspective view of the example domestic refrigeration appliance with the example drawer assembly in a second position.

Turning now to FIGS. 2A-2B, as further shown, multiple storage drawers 34 can be located within the freezer compartment 45A and/or convertible compartment 45B. For brevity, the following description will be discussed with reference to the convertible compartment 45B; however, it is understood that the described storage drawers can be similarly applicable to any of the fresh food and freezer compartments. These storage drawers 34 can include at least one multipurpose drawer 10. The multipurpose drawer 10 can accommodate at least one food item 30 in a first position and at least one bottle 32 in a second position, in which the second position of the multipurpose drawer 10 is inverted relative to the first position. While FIGS. 2A and 2B depict the refrigerator 42 as having one multipurpose drawer 10, it is to be understood that the refrigerator 42 can have any number of multipurpose drawers arranged in any configuration known in the art.

FIG. 2A is a perspective view of the domestic refrigerator 42 with an example multipurpose drawer 10 in a first position. FIG. 2B is a perspective view of the refrigerator 42 with the example multipurpose drawer 10 in a second position. The multipurpose drawer 10 is slidably disposed within the fresh food compartment via guide rails and/or a roller assembly 22 (FIGS. 3-5) described in more detail below. A multipurpose drawer 10 can be located directly above the bottom surface of the liner 46 or directly below the top surface such that no intervening, separating structures (e.g., partitions, shelves, etc.) are disposed therebetween. In another embodiment, a multipurpose drawer 10 can be positioned at a location in between the top and bottom surface of the liner 46.

The drawer assembly 10 can be accommodated in a first position (FIG. 2A) in which the open storage area is oriented upwards for normal operation of storing food items 30. In another embodiment, the drawer assembly 10 can be accommodated in a second position (FIG. 2B) in which a bottle rack 36 is oriented upwards in normal operation to accommodate at least one bottle 32. The second position is inverted or upside down relative to the first position.

The guide rails and/or roller assembly 22 permits the multipurpose drawer 10 to slide or roll to any extended or retracted position relative to the cabinet 44. The guide rails and/or roller assembly 22 also act to support the multipurpose drawer 10 within the compartment. The guide rails and/or roller assembly 22 is further configured to accommodate both of the first and second positions of the drawer 10. For example, a user can utilize the drawer in either the first position or invert the drawer assembly 10 to the second position without having to make any modifications to the guide rails and/or roller assembly 22, or to the corresponding support structure within the cabinet.

Figure 3:
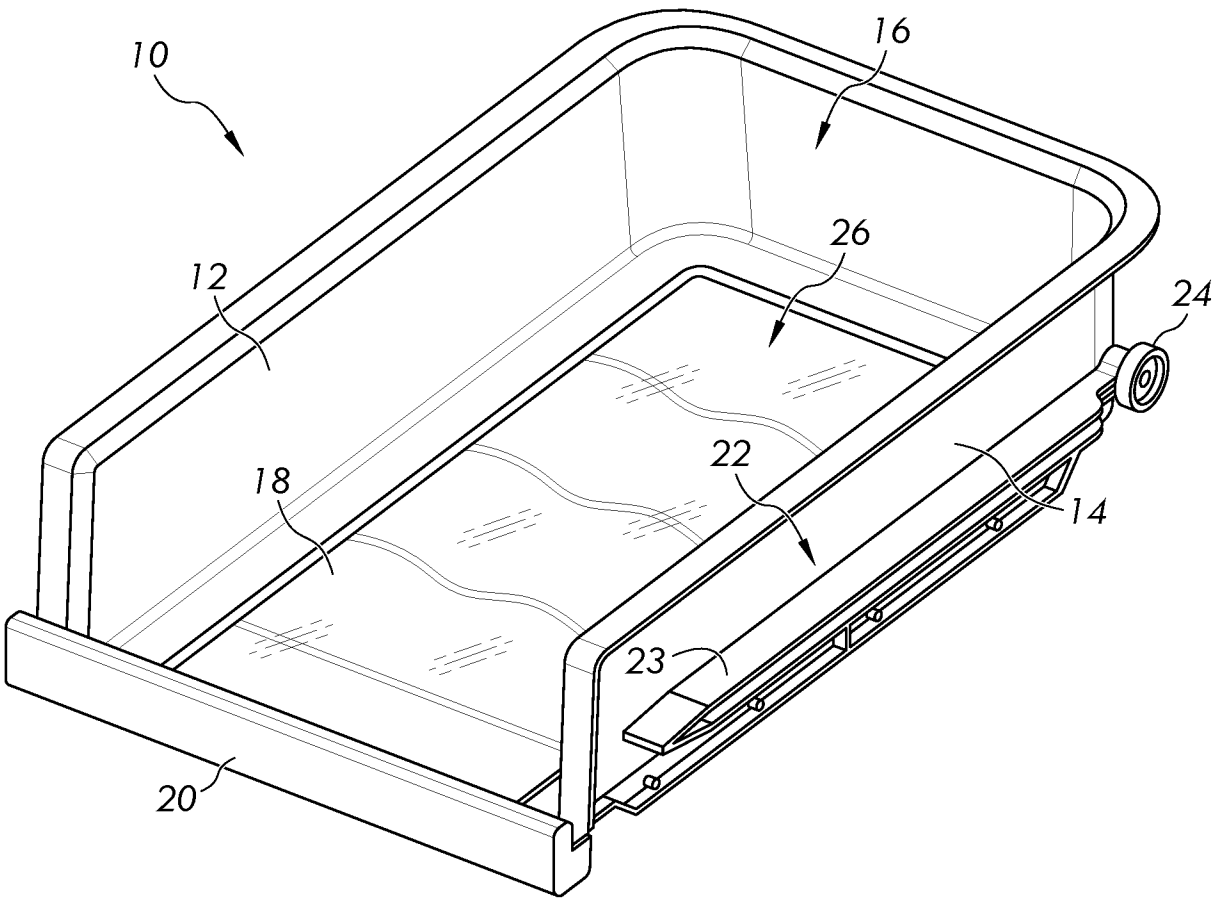
FIG. 3 is a top perspective view of the example drawer assembly.
Figure 4:
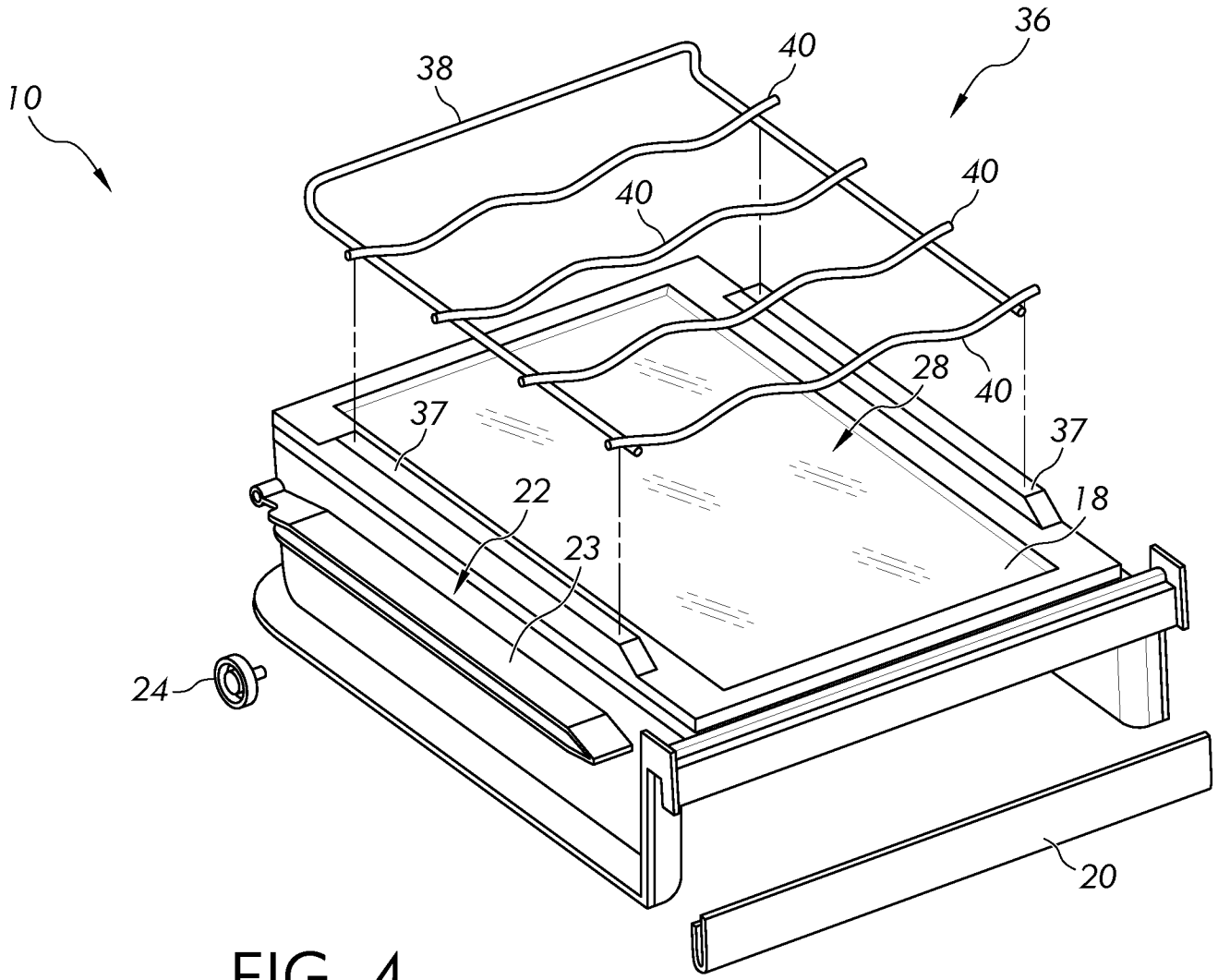
FIG. 4 is a bottom exploded view of the example drawer assembly.

Moving on to FIGS. 3 and 4, FIG. 3 is a top perspective view of the example drawer assembly. FIG. 4 is a bottom exploded view of the example drawer assembly. The multipurpose drawer 10 is shown as including a first and second side wall 12, 14, a rear wall 16, and a bottom wall 18 defining an open storage area within. Preferably, there is either no front wall, or a relatively short front wall forming a lip to prevent foods from falling out, to thereby enable ready access to the drawer interior from a front of the refrigerator. Each of the first and second side walls 12, 14 can include an interior surface and an exterior surface. The drawer walls 12, 14, 16 can be made of a plastic material, such as high impact polystyrene (HIPS). The bottom wall includes a first surface 26 defining a base of the storage area, and a second surface 28 opposite of the first surface 26. The bottom wall 18 can also be made of a transparent or semitransparent material. The bottom wall 18 can also include an opaque frame surrounding the transparent or semitransparent material. The transparent or semitransparent material can include glass, plastic, or any other suitable transparent or semitransparent material. In another embodiment, the bottom wall can be opaque. The opaque material can be made of a plastic material, such as HIPS.

The second surface 28 of the bottom wall can further include the bottle rack 36. That is, the second position of the drawer includes a rack secured to the second surface 28 of the bottom wall 18 of the drawer assembly 10. In one embodiment, the bottle rack 36 can include a frame 38 and a plurality of support members 40 arranged within the frame 38. The support members 40 can be arranged parallel to one another. In yet another embodiment, the support members 40 are arranged parallel to the front handle 20. In one embodiment, the rack 36 can include a plurality of support members 40. For example, the rack can include two, three, four, five, or even more support members. Preferably, each of the support members 40 have at least one depression, such as a curve or inverted U or V shape, which is preferably configured to accommodate or support a large bottle, such as a wine bottle or the like. The at least one depression of each support member 40 can be aligned with the at least one depression of each of the other support members along the longitudinal axis of the drawer in the extension direction. In one embodiment, each of the support members 40 include at least two depressions, preferably at least three depressions, more preferably at least four depressions, or most preferably at least five depressions. The depressions of each support member 40 are aligned such that the plurality of support members 40 can accommodate a bottle 32. The bottle rack 36 can be made of metal, plastic, or any other suitable material. In yet another embodiment, the rack 36 can be made from one material or a mixture or combination of materials.

In an alternative embodiment, the bottle rack 36 can be integral or securely fastened to the second surface 28 of the bottom wall 18. For example, the rack 36 can be integrally molded into the material (e.g., plastic) of the bottom wall 18. The rack 36 can also be secured to the bottom wall 18 via brackets, screws, friction-fit snaps, or any other suitable attachment method. In another embodiment, the second surface 28 of the bottom wall 18 can include a molded-in support mount 37 configured to receive the rack 36. In yet another embodiment, the rack 36 can be removably connected to the bottom wall 18. The rack 36 can be removably secured via snaps, clips, or any other removably securable method. As illustrated, the rack 36 can be made of metal (FIG. 4), such as a metal wire. The rack 36 can also be made of plastic, glass, or any other suitable material.

The drawer 10 can also include a front handle 20. Preferably the handle is readily available to be grasped by the user when the drawer assembly 10 is in either of the first or second positions. In one embodiment, the front handle 20 is removably secured to the side walls 12, 14. The handle 20 can be secured to the side walls 12, 14 via clips, snaps, or any other suitable removably securable method. In yet another embodiment, the front handle is formed integral with or permanently secured to the side walls 12, 14. The front handle 20 can also include a handle cover. The handle cover can be made of rubber or plastic, or any other suitable material. The handle cover can also act as decorative trim. The handle cover can be permanently or removably secured to the handle 20. For example, the handle cover can be removably secured to the handle via clips, snaps, etc. When the drawer 10 is in its upright position, the bottom of the front handle 20 is positioned immediately adjacent to or in abutment with the bottom wall 18.

Figure 5:
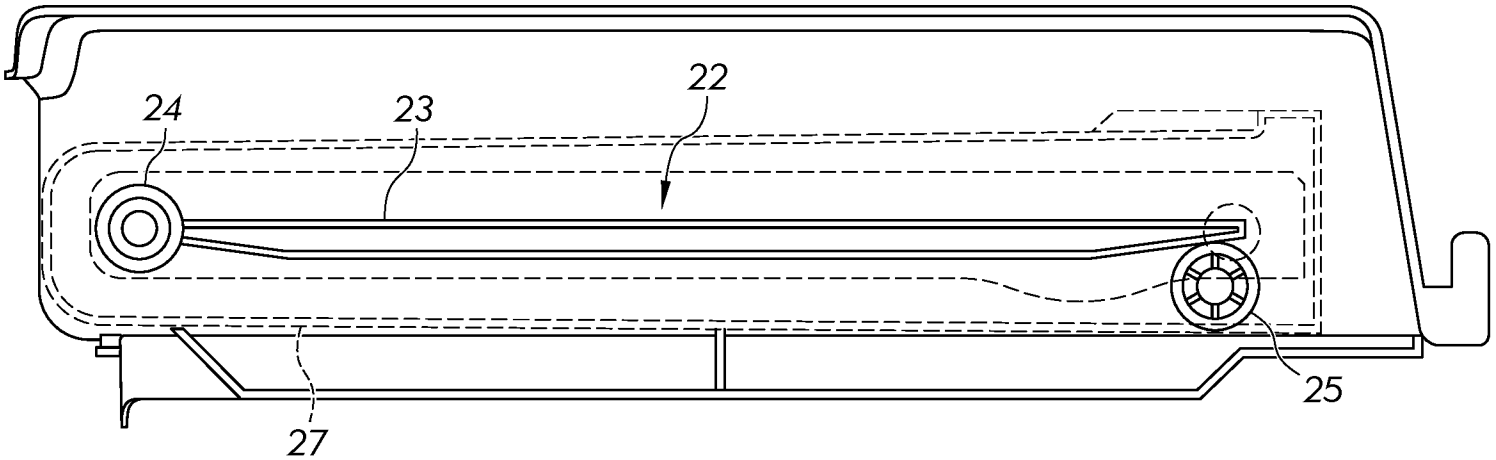
FIG. 5 is a side view of the example drawer assembly having a guide rail and/or roller assembly.

FIG. 5 is a side view of the example drawer assembly having a guide rail and/or roller assembly. In one embodiment, the guide rail and/or roller assembly 22 corresponds with each guide track 27 connected to each side of the inner cabinet. In the example drawing of FIG. 5, for clarity purposes, the guide track 27 is shown as transparent so that the components behind it can be readily visible. The guide track 27 may be removably or permanently connected to the inner cabinet. The guide rail and/or roller assembly 22 on the drawer assembly includes at least one slide rail 23 and preferably also includes at least one roller or wheel 24 disposed towards a rear end of the drawer. As illustrated, preferably the wheel 24 is bigger in diameter than the height of the slide rail 23. For example, the perimeter edge of the wheel 24 extends beyond each of the top and bottom surfaces of the slide rail 23. In this embodiment, the size of the wheel 24 allows the guide rail and/or roller assembly 22 to engage the guide track 27 of the inner cabinet in either an upright configuration (FIG. 3A) or upside-down configuration (FIG. 3B). For example, the drawer 10 is supported in the rear of the cabinet by the wheel 24 and the slide rail 23 is guided along the cabinet guide track 27 by the cabinet wheel 25 at the front end of the guide track 27. The cabinet wheel 25 rides along one of the top or bottom surfaces of the slide rail 23 (depending upon whether the drawer is in the upright or inverted position). However, it is contemplated that in some variations only slide rails will be used without rollers, whereby the slide rail 23 will glide directly upon the guide track 27. In one embodiment, a first slide rail is connected to or formed integral with the exterior surface of the first side wall 12, a second slide rail is connected to the exterior surface of the second side wall 14, and optionally at least one wheel 24 is connected (via screw, friction-fit, etc.) to each of the first and second slide rails. The first slide rail engages or receives a corresponding guide track 27 connected to the first side surface of the cabinet. The second slide rail engages or receives a corresponding slide rail or track connected to the second side surface of the cabinet. In one embodiment, the guide rail and/or roller assembly 22 is configured to accommodate the multipurpose drawer 10 in either an upright or inverted configuration. In another embodiment, any other suitable structural support (e.g., slides, glides, tracks, etc.) can accommodate the drawer 10. This configuration eliminates the need for any further modification or additional guiding structures to promote efficient movement of the drawer and switching of position.

The invention has been described with reference to the example embodiments described above. Modifications and alterations will occur to others upon a reading and understanding of this specification. Examples of embodiments incorporating one or more aspects of the invention are intended to include all such modifications and alterations insofar as they come within the scope of the appended claims.

The invention claimed is:

1. A multipurpose drawer assembly in a refrigeration appliance, comprising:

at least one drawer including first and second side walls, a rear wall, and a bottom wall that together define an open storage area therein, the drawer further comprising at least one guide rail assembly secured to an exterior of each of the first and second side walls, wherein the at least one guide rail assembly is configured to allow the at least one drawer to be moved between an extended position and a retracted position relative to the refrigeration appliance, wherein the bottom wall includes a first surface defining a base of the storage area and a second surface opposite of the first surface that forms an exterior bottom of the drawer; and a bottle rack positioned on the second surface of the bottom wall, wherein the bottle rack includes a frame and a plurality of support members arranged within the frame, each support member having at least one curve, wherein a lower surface of the at least one guide rail assembly is configured to engage said refrigeration appliance when the at least one drawer is in a first position in which the open storage area is oriented upwards in normal operation to accommodate food items within the storage area, land an upper surface of the at least one guide rail assembly is configured to engage said refrigeration appliance when the at least one drawer is in a second position in which the bottle rack is oriented upwards in normal operation to accommodate at least one bottle, the second position being inverted relative to the first position.

2. The drawer assembly of claim 1, wherein the at least one drawer further includes a front handle positioned in between the first and second side wall.

3. The drawer assembly of claim 1, wherein the bottle rack is integral to the second surface of the bottom wall.

4. The drawer assembly of claim 1, wherein the bottom wall includes a support mount configured to secure the bottle rack.

5. The drawer assembly of claim 1, wherein the bottle rack is made of metal wire.

6. The drawer assembly of claim 1, wherein the at least one guide rail assembly includes a guide rail and a wheel having a perimeter edge that extends beyond each of a top surface and a bottom surface of the guide rail.

7. A refrigeration appliance comprising:

a cabinet defining a storage space defined between first and second interior walls and including an inner guide track on said first and second interior walls, a drawer assembly including first and second side walls, a rear wall, and a bottom wall that together define an open storage area therein, and at least one guide rail assembly secured to an exterior of the first and second side walls, wherein the at least one guide rail assembly is configured to allow the drawer assembly to be moved between an extended position and a retracted position relative to the cabinet, wherein the bottom wall comprises a first surface defining a base of the storage area and a second surface opposite of the first surface that forms an exterior bottom of the drawer; and a bottle rack positioned on the second surface of the bottom wall, wherein the second surface of the bottom wall comprises an integral support mount configured to receive a frame of the bottle rack, wherein a lower surface of the at least one guide rail assembly is configured to engage the inner guide track when the drawer assembly is in a first position in which the open storage area is oriented upwards in normal operation to accommodate food items within the storage area, and an upper surface of the at least one guide rail assembly is configured to engage the inner guide track when the drawer assembly is in a second position in which the bottle rack is oriented upwards in normal operation to accommodate at least one bottle, the second position being inverted relative to the first position.

8. The refrigeration appliance of claim 7, wherein the at least one guide rail assembly includes a guide rail and a wheel having a perimeter edge that extends beyond a top and bottom surface of the guide rail.

9. The refrigeration appliance of claim 7, wherein the inner guide track includes a slide track and a guide wheel.

10. The refrigeration appliance of claim 7, wherein the bottle rack includes a frame and a plurality of support members arranged within the frame, each support member comprising at least one depression.

11. The refrigeration appliance of claim 10, wherein the at least one depression comprises a curved geometry.

12. The refrigeration appliance of claim 10, wherein each support member comprises at plurality of depressions arranged in an array extending laterally along a width of the bottom wall so that the bottle rack is configured to support multiple bottles.

13. The refrigeration appliance of claim 10, wherein the integral support mount includes a side wall that is flush with an outer edge of the first side wall of the drawer assembly.

* * * * *